United States Patent [19]

Zimmer

[11] 4,030,410

[45] June 21, 1977

[54] DYESTUFF APPLICATOR FOR SCREEN PRINTER

[76] Inventor: Peter Zimmer, Untere Sparchen 54, A 6330 Kufstein, Austria

[22] Filed: Sept. 30, 1975

[21] Appl. No.: 618,204

Related U.S. Application Data

[63] Continuation of Ser. No. 440,043, Feb. 6, 1974, abandoned.

[30] Foreign Application Priority Data

Feb. 14, 1973 Austria ..... 1330/73

[52] U.S. Cl. ..... 101/120
[51] Int. Cl.[2] ..... B41F 15/44
[58] Field of Search ..... 101/116, 119, 120, 123, 101/124; 15/256.5, 256.51

[56] References Cited

UNITED STATES PATENTS

| | | | |
|---|---|---|---|
| 1,541,787 | 6/1925 | Cadgene et al. | 101/120 X |
| 1,803,924 | 5/1931 | Vedder | 15/256.51 |
| 3,592,132 | 7/1971 | Weber | 101/119 |
| 3,878,780 | 4/1975 | Lotte | 101/120 X |
| 3,901,146 | 8/1975 | Stierlein | 101/119 |

FOREIGN PATENTS OR APPLICATIONS

| | | | |
|---|---|---|---|
| 2,006,887 | 1/1970 | France | 101/120 |

*Primary Examiner*—Edward M. Coven
*Assistant Examiner*—R. E. Suter
*Attorney, Agent, or Firm*—Ernest G. Montague; Karl F. Ross; Herbert Dubno

[57] ABSTRACT

A doctor blade device particularly for screen printing machines preferably for textile printing on webs of material, which comprises a metallic stroke lip leaf for the coating of flowable color materials on flat webs of material, and means for providing different supporting conditions over a freely projecting length of the stroke lip leaf.

3 Claims, 7 Drawing Figures

DYESTUFF APPLICATOR FOR SCREEN PRINTER

This is a continuation division of application Ser. No. 440,043, filed Feb. 6, 1974, now abandoned.

Field of the Invention

My present invention relates to a dyestuff applicator for a screen printer in which an apertured printing screen, especially a cylindrical one, overlies a flat substrate such as a textile web along a limited area of contact.

BACKGROUND OF THE INVENTION

The purpose of the such an applicator is to control the passage of dyestuff through the screen apertures onto the substrate under a pressure which ensures penetration of both larger and smaller apertures. A roller-type applicator, whose surface approaches the coacting screen surface tangentially, limits the amount of liquid dyestuff that can accumulate in the wedge-shaped space between the two surfaces in contradistinction to conventional doctor blades including an acute angle with the screen. While the presssure of the free blade edge upon the screen can be readily adjusted, such adjustment does not have any significant effect upon the relatively large body of liquid accumulating immediately upstream of that edge.

OBJECT OF THE INVENTION

The object of my present invention, therefore, is to provide an improved doctor-blade construction for a dyestuff applicator which obviates the aforestated drawback.

SUMMARY OF THE INVENTION

In accordance with my present invention, an applicator mounted on a dyestuff-supplying tube spacedly overlying the contact area between the screen and the substrate comprises a metallic doctor blade extending substantially radially downward from the tube and curving in the direction of screen movement. The blade approaches the contact area substantially tangentially to the screen and terminates in a free edge resiliently bearing thereon. In the case of a cylindrical screen, that free edge engages its inner surface substantially at its nadir.

The blade may be overlain on its concave side by elastic reinforcing means terminating short of its free edge, such as a curved resilient strip or a plurality of overlapping curved strips of different lengths. The blade could also taper in thickness from the vicinity of the supply tube to its free edge and, in that case, may be provided on its concave side with a plurality of transverse grooves whose spacing progressively diminishes toward the free edge. According to another feature of my invention, the blade may be weighted down by loading means located on an intermediate portion thereof, such as a magnetizable bar which may be attracted by a magnet disposed below the screen.

In all these instances, the straight blade section is advantageously clamped by a pair of radially projecting lips on the tube, these lips being angularly offset from the vertical against the direction of screen movement. In this way, an arc greater than 90° is available for letting the blade curve tangentially toward the screen surface with formation of a dyestuff space in the shape of a slender wedge therebetween.

BRIEF DESCRIPTION OF THE DRAWING

The above and other features of my invention will now be described in detail with reference to the accompanying drawing in which.

Specific Description

Figure 1:
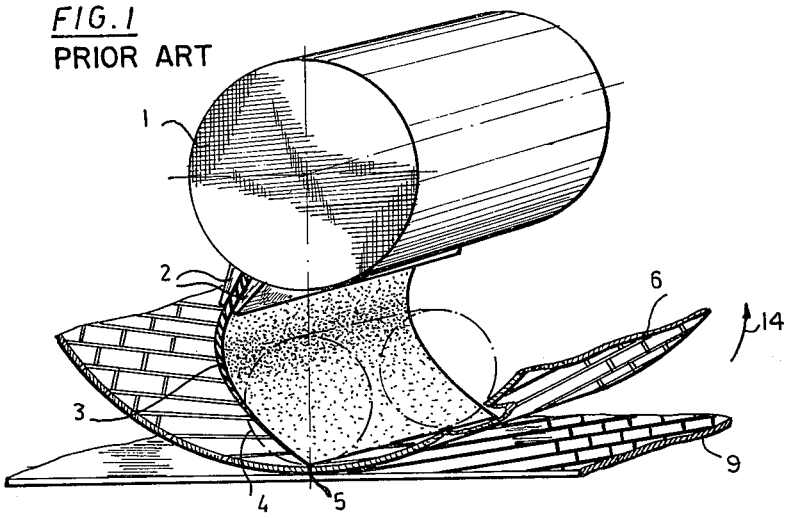
FIG. 1 PRIOR ART
FIG. 1 is a perspective fragmentary side view of a conventional screen printer equipped with a doctor blade of a configuration not conforming to the principles of my invention.

In FIG. 1 I have shown a dyestuff-supply tube 1 in the interior of an apertured printing screen 6 of cylindrical shape which contacts an underlying substrate 9 in the vicinity of its nadir 5. A doctor blade 3, mounted on tube 1 between a pair of radially projecting lips 2, extends downwardly for a short distance in a direction offset from the vertical against the direction of screen rotation, here counterclockwise as indicated by an arrow 14, and is then bent forwardly to rest with its free edge on the inner screen surface at the nadir 5, the blade and the screen including an acute angle with each other. In phantom lines I have indicated at 4 a roller applicator whose surface, in contradistinction thereto, approaches the screen surface tangentially; the lower part of the blade will be seen to cut across this imaginary roller.

Figure 2:
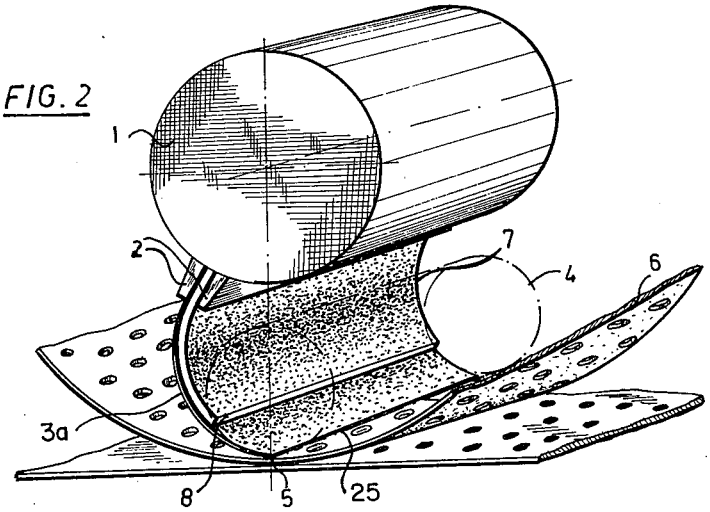
FIG. 2 is a view similar to FIG. 1, showing a blade construction according to my invention.

In FIG. 2, in which the same reference numerals have been used for identical elements, I have shown a metallic doctor blade 3*a* according to my invention whose radius of curvature decreases progressively from its mounting between lips 2 to its free edge 25 at the screen nadir 5, this blade approaching the inner screen surface tangentially so as to be also tangent to the imaginary roller applicator 4. The metallic blade is reinforced by an elastic strip 7, also clamped by the lips 2, which overlies its concave side in area contact therewith and terminates at 8 short of the free blade edge 25. The extremity of the blade is thus yieldably urged against the screen just above the area of contact to control the passage of dyestuff 21 (FIGS. 5 – 7) through the screen apertures onto the substrate 9. Strip 7 is curved in the same way as blade 3*a*, i.e. along an arc tangentially approaching the inner screen surface.

Figure 3:
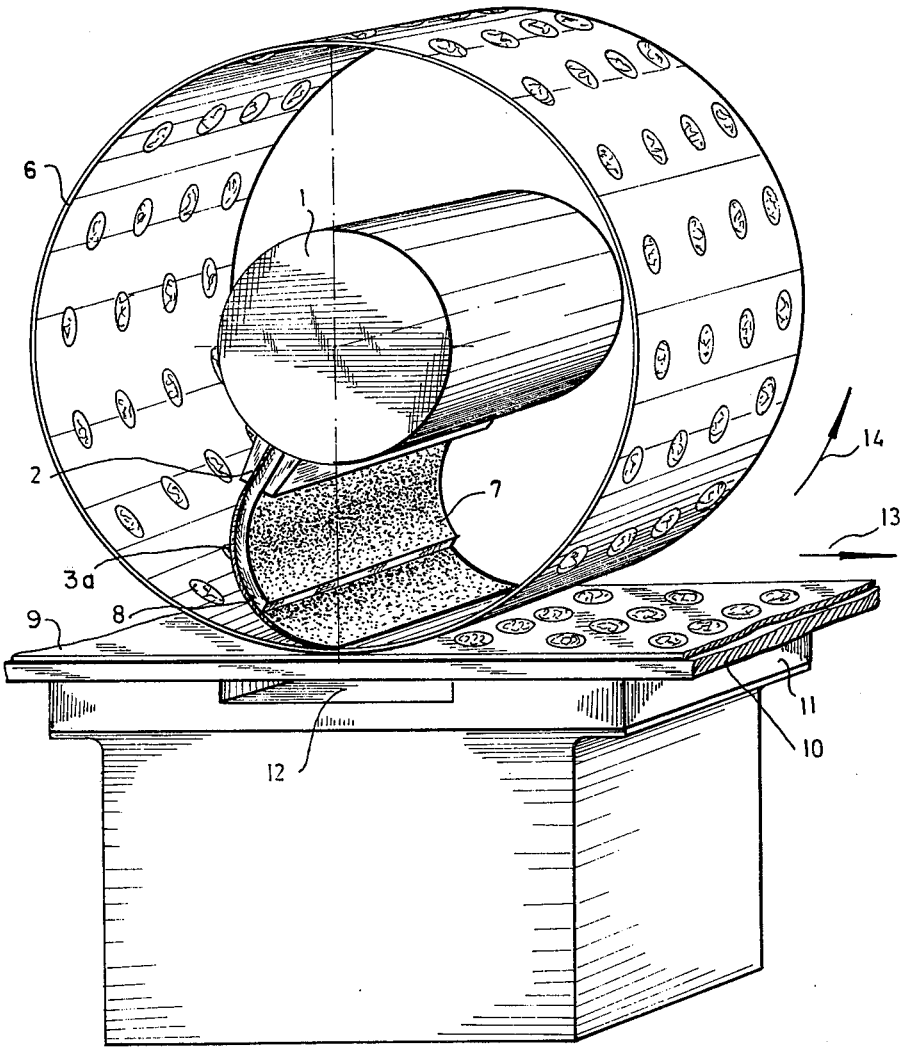
FIG. 3 is a more complete view of the screen printer shown in FIG. 2.

As shown in FIG. 3, the substrate rests on the top 10 of a printing table 11 which is made elastically yieldable in the area of contact with the aid of a recess 12. The substrate 9 moves in the same direction as the screen as indicated by an arrow 13.

Figure 4:
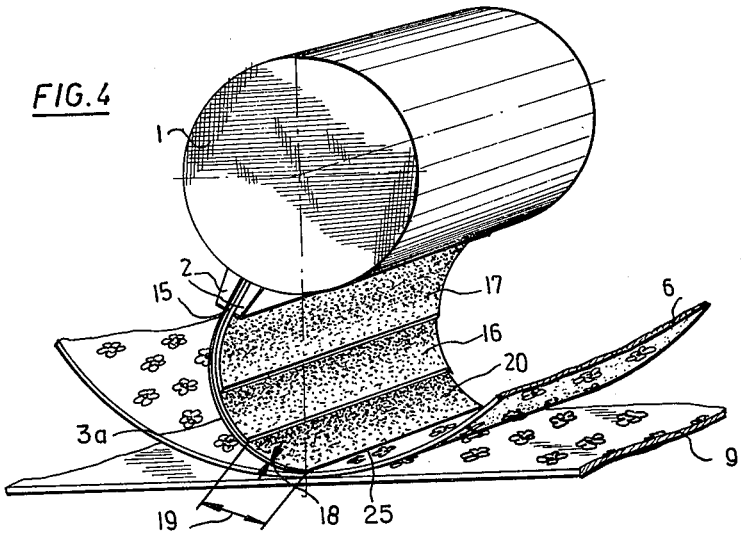
FIGS. 4, 5 and 6 are further views similar to FIG. 1, illustrating alternatives to the embodiment of FIG. 2.

FIG. 4 shows the same metallic doctor blade 3*a* overlain on its concave superposed side by a pair of curved strips 16 and 17 of different lengths, clamped together with the blade between lips 2. The longer strip 16 again terminates short of the free blade edge to leave free an extremity 20 whose thickness at the edge, indicated at 18, is a small fraction of the length 19 of that extremity but exceeds 1% of that length. As in the preceding embodiment, the radius of the blade decreases progressively from the clamping point 15 to the extremity 20.

The assembly of strips 16 and 17, like the strip 7 in FIGS. 2 and 3, hugs the concave blade surface over a major portion thereof and has a combined thickness greater than that of the blade, as clearly shown in the drawing.

Figure 5:
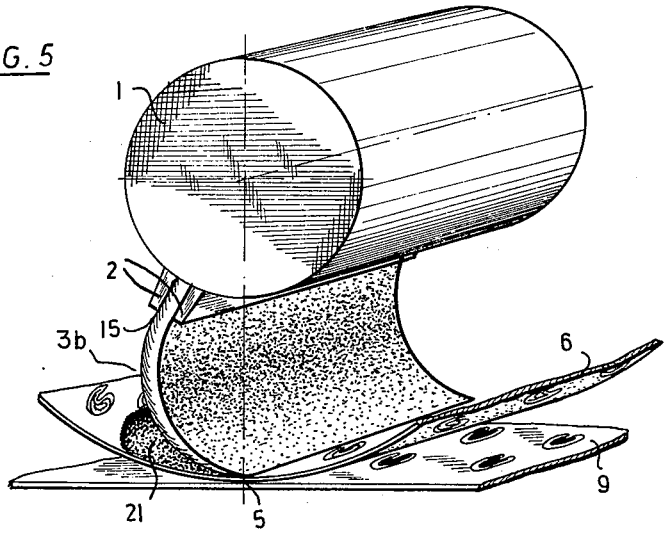

In FIG. 5 I have shown a blade 3*b*, clamped again at 15 between lips 2 but without overlying reinforcing means, which tapers in thickness from the point 15 to its free edge 25 at the point 5. Since the blade is again made of metal, its edge is not subject to objectionable deformation and a clean print can be produced.

Figure 6:
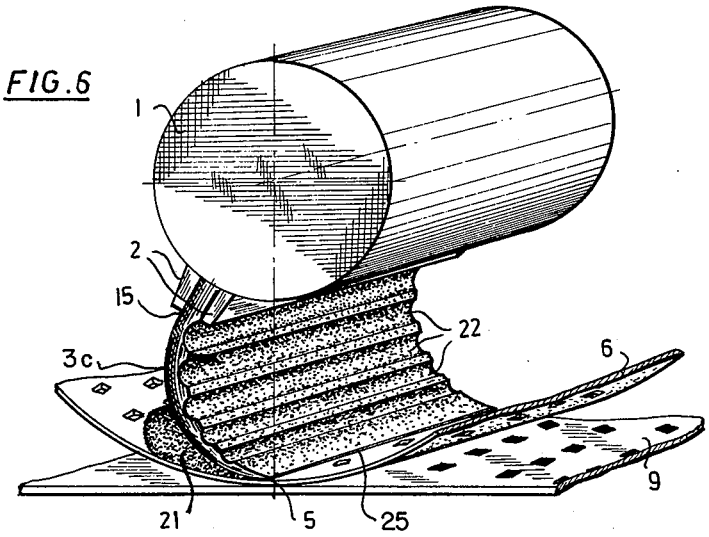

According to FIG. 6, a doctor blade 3*c* tapering as in FIG. 5 is provided with a plurality of transverse grooves 22 on its concave side, the spacing of the grooves decreasing toward the blade edge to allow for a progressive reduction of the radius of curvature.

Figure 7:
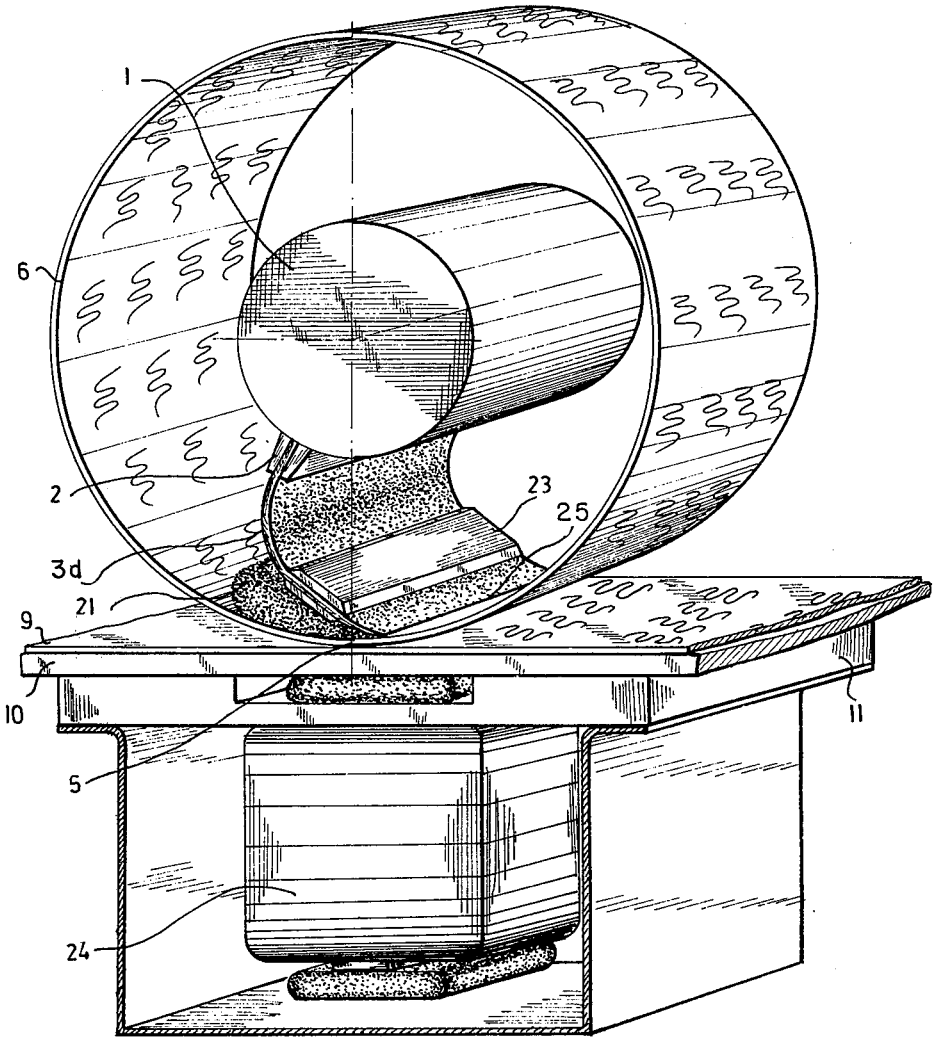
FIG. 7 is a view similar to FIG. 3, showing still another embodiment.

In FIG. 7, finally, I have illustrated a blade 3*d* which is loaded at an intermediate portion, separated by a lower blade portion from its free edge 25, by a pair of magnetizable bars 23 secured to both sides thereof, these bars being attracted downwardly by electromagnets 24 in the base of printing table 11. The bar on the lower, convex side of the blade could be suitably shaped to impart a desired curvature to the blade. The area of penetration lies approximately symmetrically with reference to the blade edge 25.

I claim:

1. In a printing machine, in combination:

a movable printing screen provided with apertures for the passage of dyestuff to an underlying substrate;

a dyestuff-supplying tube spacedly overlying a limited area of contact between said screen and said substrate;

applicator means mounted on said tube for facilitating the penetration of said dyestuff through said screen in said area of contact, said applicator means comprising a metallic doctor blade extending substantially radially downward from said tube and curving in the direction of screen movement, said blade approaching said area of contact substantially tangentially to said screen and terminating in a free edge bearing resiliently upon said screen;

elastic strip means hugging said blade on the concave side thereof for reinforcing same, said strip means having a thickness greater than that of said blade and extending over the major part of the blade surface with a curvature conforming to that of said blade and terminating short of said free edge thereof and of the inner screen surface, said tube being provided with a pair of radially extending lips clamping sections of said blade and of said strip means between them, said lips being angularly offset from the vertical in a direction opposite the direction of screen movement.

2. The combination defined in claim 1 wherein said strip means comprises a plurality of superposed curved strips of different lengths all clamped between said lips.

3. In a printing machine, in combination:

a movable printing screen provided with apertures for the passage of dyestuff to an underlying substrate;

a dyestuff-supplying tube spacedly overlying a limited area of contact between said screen and said substrate;

applicator means mounted on said tube for facilitating the penetration of said dyestuff through said screen in said area of contact, said applicator means comprising a metallic doctor blade extending substantially radially downward from said tube curving in the direction of screen movement, said blade approaching said area of contact substantially tangentially to said screen and terminating in a free edge bearing resiliently upon said screen;

a pair of magnetically attractable bars lying flat against opposite surfaces of said blade while being separated from said free edge thereof by a lower blade portion in line with said surfaces; and magnet means below said screen exerting a downward force upon said bars.

* * * * *